US005312634A

United States Patent [19]

Griesbach et al.

[11] Patent Number: 5,312,634

[45] Date of Patent: May 17, 1994

[54] COMPACT PACKAGE FOR FOOD PRODUCT

[75] Inventors: Ray Griesbach, Monona; Jeffrey M. Lipinski, Sun Prairie, both of Wis.

[73] Assignee: Oscar Mayer Foods Corporation, Madison, Wis.

[21] Appl. No.: 412,320

[22] Filed: Sep. 26, 1989

[51] Int. Cl.[5] ..... B65D 85/00

[52] U.S. Cl. ..... 426/106; 206/470; 206/561; 426/120

[58] Field of Search ..... 426/106, 114, 115, 116, 426/119, 120; 206/561, 470, 456; 220/20, 23.8; 229/120.09, 541, 463

[56] References Cited

U.S. PATENT DOCUMENTS

| | | | |
|---|---|---|---|
| D. 305,204 | 12/1989 | Reifein et al. | D9/418 |
| 2,858,224 | 10/1958 | Darrah | 229/120.09 |
| 2,959,338 | 11/1960 | Thurston | 229/120.09 |
| 3,933,296 | 1/1976 | Ruskin et al. | 206/541 |
| 4,120,394 | 10/1978 | Soltes | 206/561 |
| 4,241,863 | 12/1980 | Faller | 229/120.09 |
| 4,273,815 | 6/1981 | Gifford et al. | 426/106 |
| 4,498,588 | 2/1985 | Scott | 426/106 |

FOREIGN PATENT DOCUMENTS

| | | | |
|---|---|---|---|
| 651755 | 1/1964 | France | 206/219 |

OTHER PUBLICATIONS

"Oscar Mayer Introduces . . . Little Oscar's Lunch Pack", 1986.

"Oscar Mayer Introduces . . . Fresh Deli Combinations", 1987.

"Oscar Mayer Introduces . . . Little Oscar's Lunch Fixings", 1986.

"Oscar Mayer Introduces . . . Lunch Packs", 1985.

"Oscar Mayer Introduces . . . Meat Salads with Mini Breads", 1987.

Publication—"Fresh Deli Combinations", Prior to Sep. 26, 1988.

*Primary Examiner*—Donald E. Czaja

*Assistant Examiner*—Anthony Weier

*Attorney, Agent, or Firm*—Larson and Taylor

[57] ABSTRACT

A food package having opposed upper and lower rigid parts which are hinged together to meet along adjacent reference planes. Each part has flanges located in its respective reference plane and at least one food receiving recessed compartment extending away from its respective reference plane and away from the other part. A flexible film located in each reference plane is attached to the flanges of that part, surrounding its respective recessed compartment(s), to airtightly seal the contents thereof.

23 Claims, 4 Drawing Sheets

FIG. 3
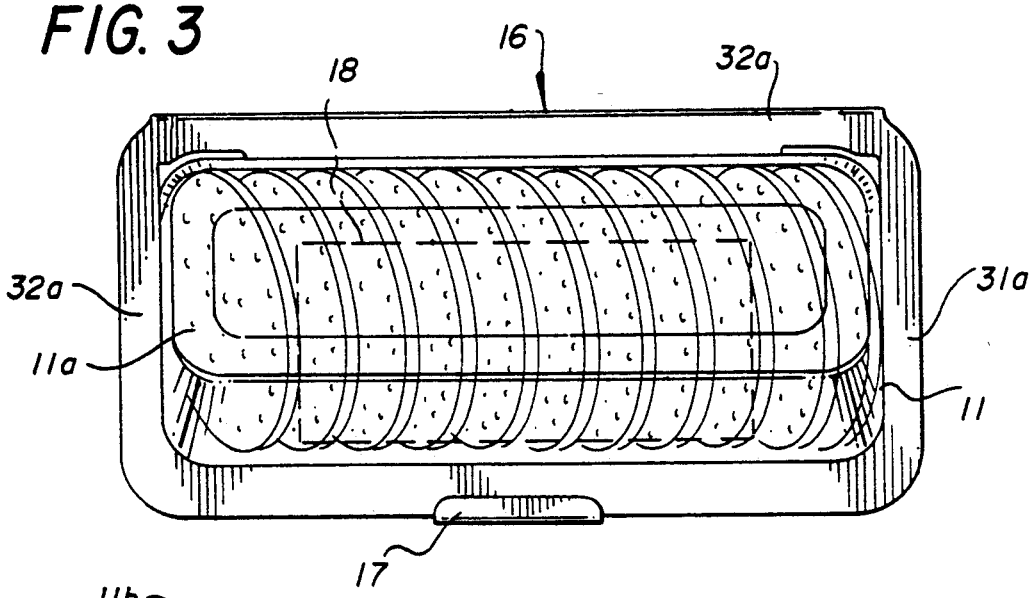
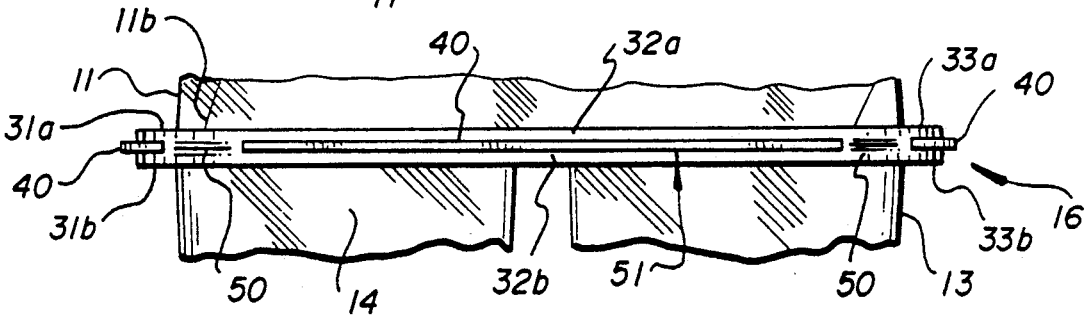
FIG. 4
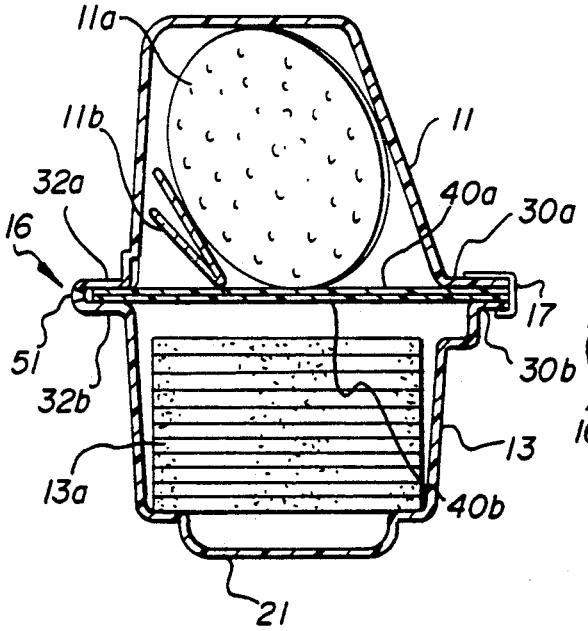
FIG. 5
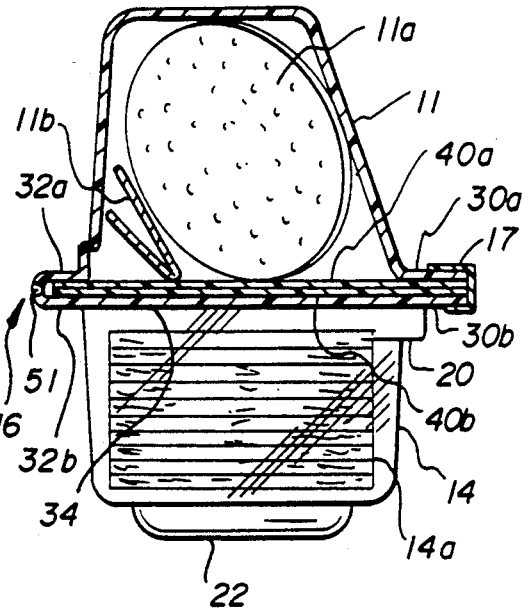
FIG. 6

COMPACT PACKAGE FOR FOOD PRODUCT

FIELD OF THE INVENTION

This invention relates to packages, and in particular it relates to a compact package for food products or the like.

BACKGROUND OF THE INVENTION

A food package must serve several diverse purposes. First, it must adequately preserve the food product itself during handling, shipping, storage and the like. This requirement is met by providing the package with adequate strength and sealing characteristics. A second purpose of a package is to meet the special requirements related to the method of distribution and sale as well as the manner of use of the package by the ultimate consumer.

For example, in the context of a food package which is intended to be sold through vending machines or the like severe space restrictions demand that these goals of adequate strength and sealing characteristics be achieved in a relatively compact package.

In addition, since selection of a product by the consumer is often dependent on its physical appearance, it is also necessary that the package be attractive in appearance and efficiently display the food contents therein. Also, where the package is to be used as a container during the consumption of the food, and not simply discarded prior to such consumption, the package must also be constructed so as to satisfy this purpose.

There exists a continuing need for new and improved food packages of the above described type.

SUMMARY OF THE INVENTION

It is a purpose of the present invention to provide a new and improved package, especially for food products or the like, and in particular one which is relatively compact and yet has adequate strength and sealing characteristics.

These and other purposes of the present invention are achieved by providing a unique package comprising a pair of opposed upper and lower parts, each formed of a rigid material, the parts being foldable about a hinge means into engagement with each other, and the compartments themselves being airtightly sealed with a flexible film.

In a preferred arrangement, the package comprises upper and lower rigid parts, each part comprising flanges lying in a reference plane and recessed compartments extending away from the reference plane in a direction away from the other part. Along one edge of the package upper and lower part peripheral flanges are joined together by a hinge means. The recessed compartments are airtightly sealed by a flexible film which is adhered to the flanges surrounding the respective compartments.

The upper and lower parts are preferably of the same height so that when the two parts are in the unfolded condition, their upper surfaces containing the flanges are generally in the same plane while the bottoms of the recessed compartments are also in the same plane. With this construction, with the upper and lower parts unfolded from each other the two parts are generally coplanar so that the upper surfaces of both parts containing the flanges are generally coplanar while the bottoms of both parts are also coplanar. Because of this construction, the package in the unfolded condition exposes all recessed compartments in a common plane, thereby facilitating (a) filling and sealing all of the compartments with the appropriate food products or the like and (b) use of the package as a tray by the ultimate consumer when consuming the contents of the package.

In a preferred embodiment of the present invention, the package, when in the unfolded condition is essentially square with the fold line dividing the package symmetrically into two elongated rectangles. Preferably one half of the package which will form the upper part includes a single recessed compartment therein while the other half, which will form the lower part comprises a pair of smaller generally square recessed compartments therein. With this particular arrangement, one can match the appropriate food products to the respective compartments. The more expensive dense proteinaceous food products such as meat, cheese, or the like would be provided in the two smaller recessed compartments of the lower part while the larger compartment of the upper part would be utilized for a larger volume farinaceous component such as crackers, as well as napkins or the like.

The flexible film serves two separate and distinct purposes. First, as explained above, when adhered to the peripheral flanges surrounding the respective recessed compartments, it airtightly seals those compartments to keep the contents thereof fresh during normal shipment and sale in commerce. In addition thereto, by tightly closing off the respective compartments, the film also securely positions the food products in their respective compartments during further processing including folding the upper part over onto the lower part. In addition, the appearance of the product is enhanced throughout its shipment, handling and placement in a store display case or vending machine because the flexible film will maintain all of the food contents in their respective compartments, assuring for example that the food products in the compartment of the upper part do not fall into the compartments of the lower part or vice versa (as would occur if the package were turned upsidedown in handling, shipping, or the like).

Thus, it is an object of the present invention to provide a new and improved food package which is compact and yet has adequate strength and sealing characteristics.

It is another object of the present invention to provide a new and improved food package of the type described which is especially adapted for selling perishable food products through a vending machine.

It is still another object of the present invention to provide a new and improved product for selling perishable foods or the like through a vending machine which is both compact, so as to present a sufficient quantity of food in a relatively small space and convenient for use by the ultimate consumer in the consumption of the food product.

These and other objects of the present invention will become apparent from the detailed description to follow.

BRIEF DESCRIPTION OF THE DRAWINGS

There follows a detailed description of preferred embodiments of the present invention which are to be taken together with the accompanying drawings, wherein:

FIG. 3 is a top plan view of FIG. 1.

FIG. 4 is a partial rear elevational view of the food package of FIG. 1.

FIGS. 5 and 6 are cross-sectional views, taken along lines 5—5 and 6—6 of FIG. 1, respectively, and with the thicknesses of the component materials exaggerated in order to illustrate the present invention.

DETAILED DESCRIPTION OF THE PREFERRED EMBODIMENTS

Referring to the figures like elements are referred to by like numerals throughout the several views.

Figure 1:
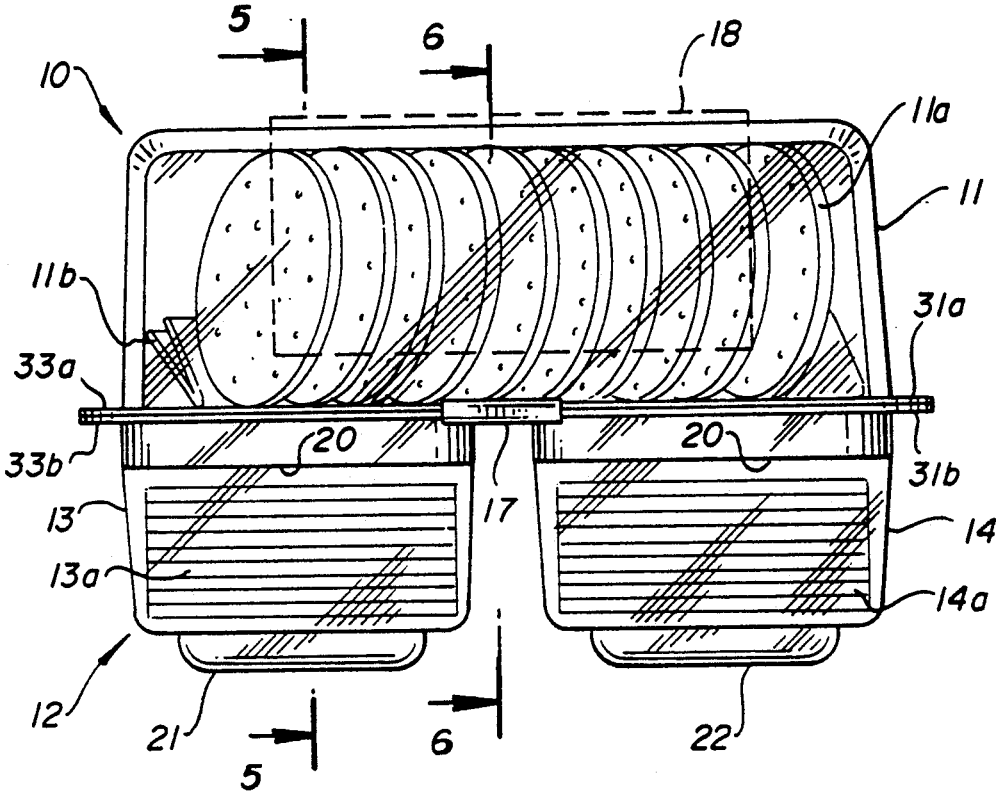
FIG. 1 is a front elevational view of a food package made according to the present invention.
Figure 2:
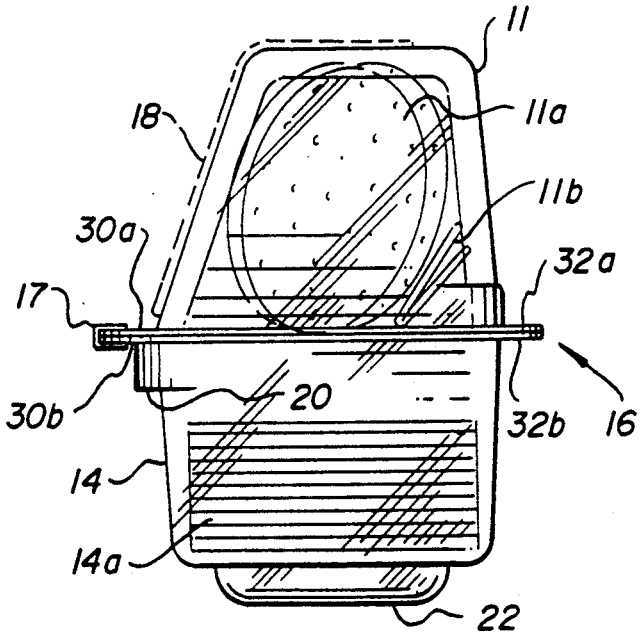
FIG. 2 is a side elevational view, taken from the right hand side of FIG. 1.
Figure 7:
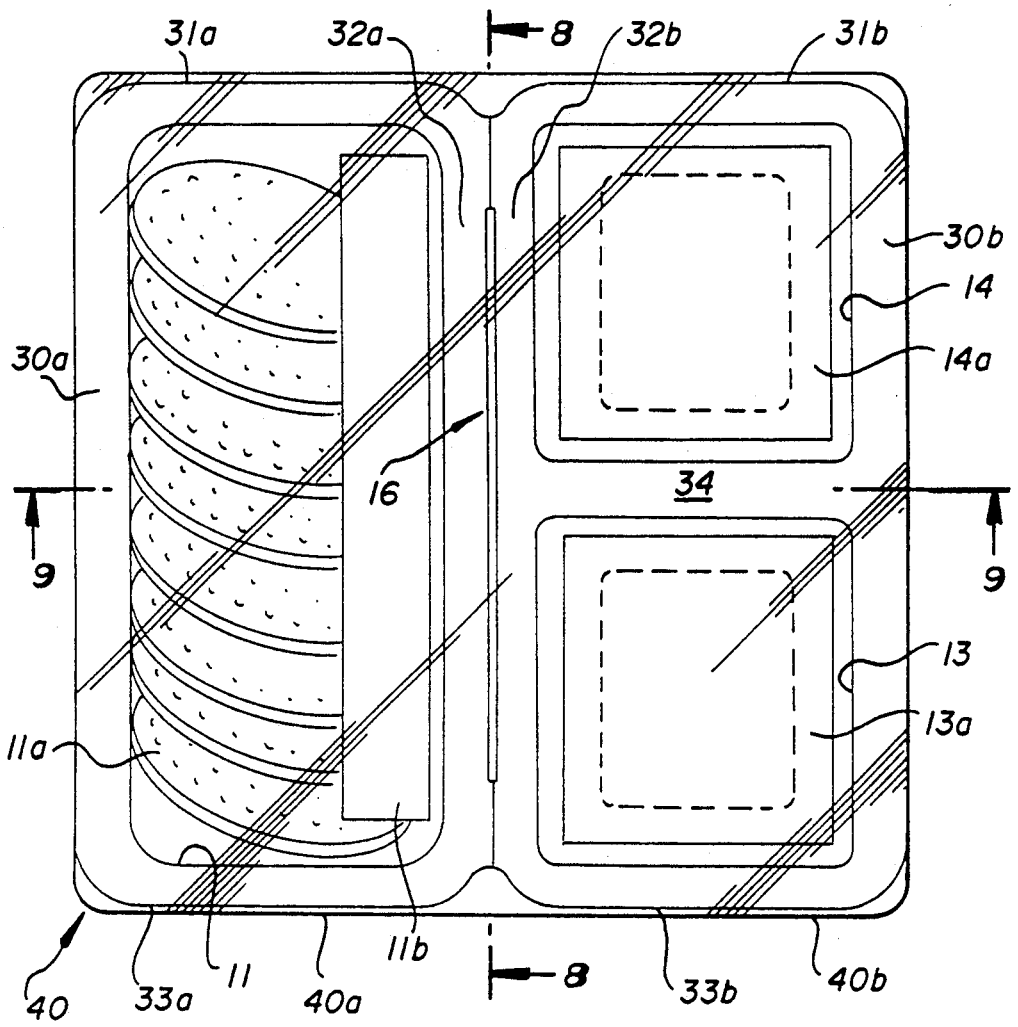
FIG. 7 is a plan view of the package of FIG. 1 with the upper part unfolded and lying in the same plane as the lower part.
Figure 8:
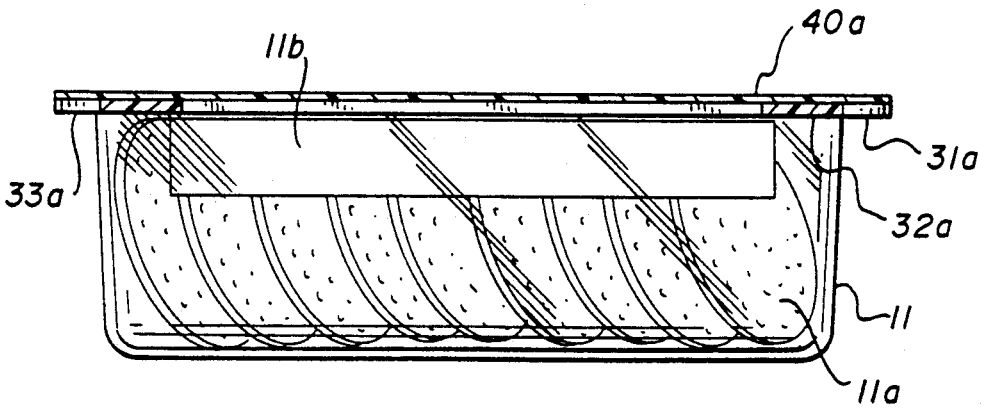
FIGS. 8 and 9 are cross-sectional views taken along lines 8—8 and 9—9 of FIG. 7, respectively, with the thicknesses of the component materials exaggerated in order to illustrate the features of the present invention.
Figure 9:
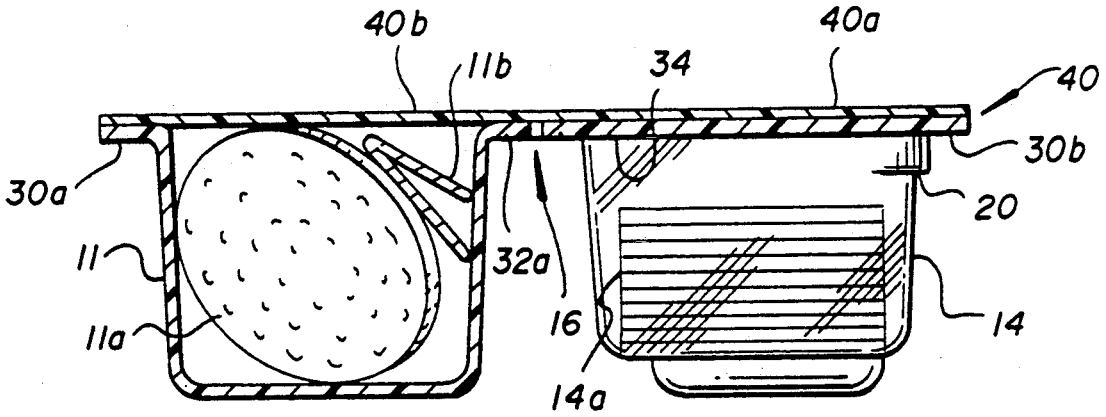

FIGS. 1 through 6 illustrate the package of the present invention in its fully assembled form. The package 10 comprises an upper part 11 which in this embodiment comprises a single recessed compartment and a lower part 12 which in this illustrated embodiment comprises a pair of recessed compartments 13 and 14. Referring to FIG. 7 as well as FIGS. 1 through 6, the package of the present invention is formed from a single rigid material joined together in the vicinity of a rear hinge 16 (to be described in greater detail below). Each part defines a reference plane comprising flanges. Upper part 11 comprises a front flange 30*a*, a rear flange 32*a*, a side flange 31*a* and an opposed side flange 33*a*. All of these flanges lie in a common plane, which is referred to as the reference plane. The walls of recessed compartment 11 start from the inner edges of these flanges and extend downwardly to form the compartment itself. The lower part 12, as illustrated on the right hand side of FIG. 7, comprises a front flange 30*b*, a rear flange 32*b*, and opposed side flanges 31*b* and 33*b*. Since the lower part 12 comprises a pair of recessed compartments 13 and 14, an additional flange, namely divider flange 34 is provided to separate the two recessed compartments.

The package is initially filled while in the unfolded condition as illustrated in FIG. 7. After the food products or the like are placed in the recessed compartments, a flexible film is placed against and sealed to the flanges 30 through 34, thereby airtightly sealing the respective recessed compartments 11, 13 and 14. Preferably the flexible film is taut, and not loose or flabby after sealing. Thereafter, the package is folded about the hinge 16 into the condition as illustrated in FIGS. 1 through 6. The package is held in this closed condition by any suitable means, one example being a pressure sensitive tab 17. Other suitable means of holding the package in the closed condition include adhesives, welding, such as by ultrasonics, and mechanical closures.

Referring to FIGS. 1 through 6, there is illustrated additional details of the finished package. In a preferred arrangement, the upper part 11 may comprise crackers 11*a* and a napkin 11*b*. Preferably the package would include in the lower compartments slices of meats or cheeses, illustrated for example at 13*a* and 14*a*. The package could of course include any other food product including poultry, fish, or the like.

Shoulders 20 are provided so that when the rigid packages are stacked prior to assembly, these shoulders will separate the flange portions from each other, thus facilitating the separation of one package from the remaining packages in an automated production line. In this illustrated embodiment the compartments 13 and 14 each comprise "feet" 21 and 22, respectively. In many packages, the lower compartments containing the meat and cheese products are generally not as large in height as the upper cracker containing compartment 11. However, it is preferable that the lower part be the same height below its respective flanges as the upper part above its respective flanges. Such construction will facilitate arranging the upper and lower parts side by side in a common plane during the filling stage and also assure that the upper and lower parts are even with each other after the consumer has opened the package to consume the contents.

An advantage of this invention is that it provides a very convenient and highly visible location for the placement of a suitable label. This area which extends along the front and top of upper part 11 is illustrated by dotted lines 18 in FIGS. 1 through 3.

The flexible film 40 is illustrated in FIG. 7 as a single sheet which is placed across the entire package while still in its unfolded condition. After folding, the film 40 forms an upper film 40*a* and a lower film 40*b* as illustrated in FIGS. 5 and 6.

A preferred form of the hinge 16 is best illustrated in FIG. 4. The rear flanges 32*a* and 32*b* meet along a line which is to form the hinge. It is important that the fold of this hinge be sufficiently durable so that it will not break in the course of commercial packaging, handling and storage in commerce. Concurrently, however, it is preferable that the hinge be as thin and neat as possible so as to provide an attractive package, while providing a sufficient space between the opposed sets of flanges to safely receive and accommodate the folded flexible film 40 as upper and lower films 40*a* and 40*b*. In a preferred arrangement two areas 50 towards the outer ends of these flanges are retained while a length 51 between them is provided with a very narrow slit. In the formation of the rigid material which forms the upper and lower parts, the areas 50 are preferably thinned so as to facilitate folding of the package in those areas.

Figure 10:
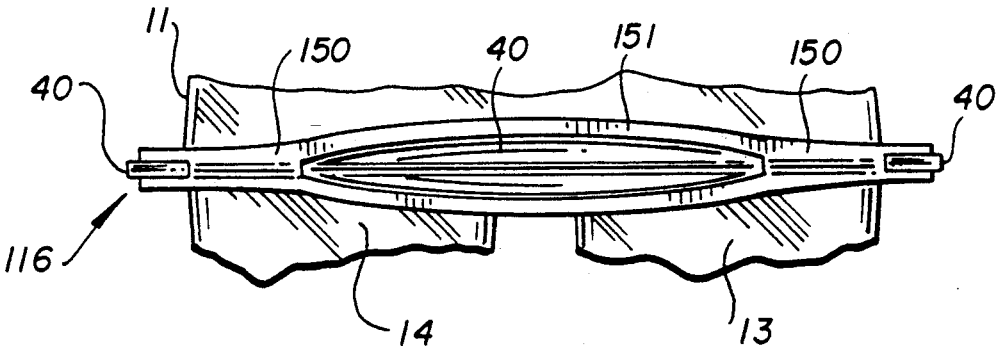
FIG. 10 is a partial rear elevational view similar to FIG. 4, but showing a modification.
Figure 11:
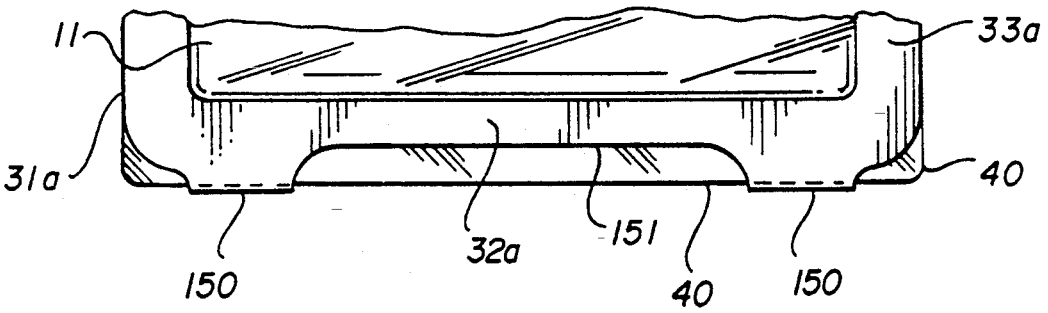
FIG. 11 is a partial plan view of FIG. 10.

FIGS. 10 and 11 illustrate another embodiment of a hinge. In this embodiment the retained areas 150 are not thinned. Instead of a very narrow cut 51, the space between the retained hinged areas 150 is provided with a relatively large slotted cutout 151. The hinge construction of FIGS. 1 through 9, as best illustrated in FIG. 4, is preferred over the hinge embodiment of FIGS. 10 and 11 because the former can be folded more easily into a flat condition, thus providing a more attractive package.

The rigid upper and lower parts are preferably made of acrylonitrile copolymers, polyesters, polypropylene, polyvinylchloride, or polyester copolymers. The rigid parts are preferably transparent, as is depicted in the figures, so that the food products therein will be visible. The material which forms the upper and lower parts will preferably have a thickness of about 20 mils and at its thinnest point, the thin portions 51 will have a thickness of approximately 2–5 mils. The flexible film 40 is preferably a multi-layer film, wherein one layer is preferably polyester, nylon, polypropylene or polyethylene while the other layer is an adhesive layer containing an antifogging additive or coating. The film may also contain an oxygen barrier layer such as saran ethylene vinyl alcohol. Moreover, the film 40 is preferably transparent.

The film 40 may be attached to the flanges of the rigid upper and lower parts by any suitable means including heat sealing, glue or ultrasonic sealing. The attachment of the film to the flanges of the rigid parts should be of the type which, while sufficiently airtight, permits the film to be easily peeled away from these flanges with digital pull apart force without delamination of the multi-layer film.

An advantage of the present invention is that it can provide a unique and highly desirable collection of food products in a relatively small, compact and yet highly durable package suitable for example for commercial vending machines. A typical package of the present invention would be approximately 4 inches in length, 2 inches in width, from front to back and approximately 3 inches in height, i.e., in the assembled condition from the bottom of the lower part to the top of the upper part. In the figures, food products have been shown within the package primarily for purposes of illustration. However, it will be apparent that the present invention is applicable for any product. It is preferable for food products since it provides airtight recessed compartments. However, any other suitable product can be provided within the compartments.

Although the invention has been described with respect to preferred embodiments, it will be apparent that the invention is capable of numerous modifications and variations, apparent to those skilled in the art, without departing from the spirit and scope of the invention.

We claim:

1. A compact food package hermetically sealing a perishable food snack for transport in commerce and sale in a space confined environment, the overall shape of said package being of a height above a bottom thereof which is greater than its width, and less than its length, and thus of a shape which can stand up on its bottom in a confined space, said package formed of a material sufficiently rigid to maintain its shape and prevent physical damage to the food contents during normal travel of the package in commerce, said package also being transparent so as to permit viewing of food contents prior to opening of the package, said package comprising, opposed rigid upper and lower parts, each part comprising flanges in respective reference plans, which reference planes are generally adjacent and parallel to each other, a hinge means joining opposed side flanges along one side of the package, such that the two parts fold about said hinge means, bringing the flanges of the upper and lower parts toward each other, such that the outer periphery of the upper and lower flanges essentially mate with each other, and such that the upper and lower parts are of essentially the same height above the below their respective flanges, and a flexible film covering the recessed compartments and attached to the flanges surrounding such recessed compartments, essentially in their respective reference planes, air-tightly sealing the contents within their respective compartments, the upper part having a compartment running essentially the full length and width of the package, a farinaceous food product contained within said compartment of the upper part, the lower part having at least two compartments, each containing a proteinaceous food product which has a higher density than the food product in the upper part, the compartment of the upper part thus being a large compartment, namely larger than the compartments of the lower part.

2. A package according to claim 1, wherein the upper part has single large recessed compartment surrounded by a continuous peripheral flange and the compartments of the lower part are separated by a divider flange or flanges which are collectively encircled by a peripheral flange which opposes the peripheral flange of the other part.

3. A package according to claim 1, wherein both parts have a height of approximately 1½ inches.

4. A package according to claim 1, wherein both parts are approximately 4 inches long, 2 inches wide and 1½ inches in height.

5. A package according to claim 1, wherein the hinge means is formed by the two edges of said opposed side flanges being joined to each other.

6. A package according to claim 5, wherein the opposed side flanges are integral with each other with a portion of reduced thickness at the outer edge thereof where they join.

7. A package according to claim 6, wherein the said outer edge is slit completely through its thickness between a plurality of spaced apart thinned portions.

8. A package according to claim 5, wherein an enlarged slot is cut out of the outer edges of said opposed side flanges, leaving flexible hinge portions of said flanges integral with each other and of the same thickness as that of the opposed flanges.

9. A package according to claim 1, wherein the flexible film is transparent.

10. A package according to claim 1, wherein the rigid upper and lower parts are selected from the group consisting of acrylonitrile copolymers, polyesters, polypropylene, polyvinylchloride and polyester copolymers.

11. A package according to claim 10, the flexible film being a multi-layer film.

12. A package according to claim 11, wherein at least one layer of the multi-layer film comprises a material selected from the group consisting of polyester, nylon and polyethylene.

13. A package according to claim 1, wherein the flexible film is a multi-layer film and at least one layer thereof comprises a material selected from the group consisting of polyester, nylon and polyethylene.

14. A package according to claim 1, wherein the flexible film is attached to the flanges of the upper and lower parts by heat sealing, glue or ultrasonic sealing.

15. A package according to claim 1, at least one of the compartments containing cheese.

16. A package according to claim 1, wherein the upper part has a single large recessed compartment surrounded by a continuous peripheral flange and the lower part has two recessed compartments which are separated by a divider flange and which are collectively encircled by a peripheral flange which opposes the peripheral flange of the upper part, and wherein each of the two lower part recessed compartments contain food taken from the group consisting of meat, poultry and fish.

17. A package according to claim 1, wherein the upper part has a single large recessed compartment which is approximately 4 inches in length, 2 inches in width and 1½ inches in height and the lower part comprises a pair of recessed compartments, said lower part being approximately 4 inches long, 2 inches wide and 1½ inches in height.

18. A package according to claim 1, including holding means for holding the upper and lower parts together.

19. A package according to claim 18, wherein the holding means comprises a pressure sensitive adhesive tab engaging the flanges of the upper and lower parts on the opposite side of the package from said hinge means.

20. A package according to claim 1, including a single large recessed compartment in the upper part and a pair of recessed compartments in the lower part and a label attached to the upper part.

21. A package according to claim 1, including a flexible film is attached to the flanges with an easily peelable attachment.

22. A package according to claim 1, including three recessed compartments, one compartment containing cheese, one compartment containing meat, poultry or fish, and the other compartment containing crackers.

23. A package according to claim 22, including a single large recessed compartment in the upper part and a pair of recessed compartments in the lower part, the crackers being in the large compartment, the cheese being in one of the lower part compartments and the meat, fish or poultry being in the other lower part compartment.

* * * * *